US010072407B2

(12) United States Patent
Urata et al.

(10) Patent No.: US 10,072,407 B2
(45) Date of Patent: Sep. 11, 2018

(54) FLUSH TOILET

(71) Applicant: TOTO LTD., Kitakyushu-shi, Fukuoka (JP)

(72) Inventors: Shinichi Urata, Kitakyushu (JP); Tsuyoshi Ozeki, Kitakyushu (JP); Hiroshi Tomonari, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/452,866

(22) Filed: Mar. 8, 2017

(65) Prior Publication Data

US 2017/0268214 A1 Sep. 21, 2017

(30) Foreign Application Priority Data

Mar. 18, 2016 (JP) ..... 2016-056125

(51) Int. Cl.
*E03D 11/00* (2006.01)
*E03D 11/08* (2006.01)
*E03D 1/00* (2006.01)

(52) U.S. Cl.
CPC ..... *E03D 11/08* (2013.01); *E03D 1/00* (2013.01); *E03D 2201/40* (2013.01)

(58) Field of Classification Search
CPC ..... E03D 11/08
USPC ..... 4/420, 421–424
See application file for complete search history.

(56) References Cited

U.S. PATENT DOCUMENTS

2012/0284911 A1 11/2012 Kamiya et al.
2014/0289947 A1* 10/2014 Hirakawa ..... E03D 11/08 4/421

FOREIGN PATENT DOCUMENTS

JP 2015-068125 A 4/2015
JP 2015-068126 A 4/2015
JP 2015-068127 A 4/2015

OTHER PUBLICATIONS

The extended European search report issued by the European Patent Office on Jul. 19, 2017, which corresponds to EP17160233.7-1614 and is related to U.S. Appl. No. 15/452,866.

* cited by examiner

*Primary Examiner* — Christine Skubinna
(74) *Attorney, Agent, or Firm* — Studebaker & Brackett PC

(57) ABSTRACT

A flush toilet of present invention includes a bowl that includes a bowl-shaped waste receiving surface, a rim formed above the waste receiving surface, and a pooled water portion formed below the waste receiving surface, a discharge passage that has an inlet connected to the pooled water portion and discharges waste, and a spout portion that spouts flush water onto the bowl and forms a swirling flow on the waste receiving surface. The waste receiving surface of the bowl has a sectorial recess that is formed between a front end portion of the waste receiving surface and a front end portion of the pooled water portion so as to spread from the pooled water portion toward the front end portion of the waste receiving surface.

5 Claims, 8 Drawing Sheets

| | Vertical distance from central bottom surface of recess to shelf [mm] | Radius of curvature of recess [mm] |
|---|---|---|
| Cross-section VI-VI | 20 | 115 |
| Cross-section VII-VII | 38 | 85 |
| Cross-section VIII-VIII | 52 | 64 |
| Cross-section IX-IX | 68 | 15 |

FLUSH TOILET

BACKGROUND OF THE INVENTION

Field of the Invention

The present invention relates to a flush toilet and, more particularly, to a flush toilet which clean the toilet with flush water supplied from a flush water source and discharges waste.

Description of the Related Art

As disclosed in, for example, Japanese Patent Laid-Open Nos. 2015-68126, 2015-68125, and 2015-68127, a flush toilet which is not provided with a jet spout to reduce manufacturing cost has been known. Japanese Patent Laid-Open Nos. 2015-68126, 2015-68125, and 2015-68127 each disclose that such a flush toilet has a convex surface along a lateral direction formed in each of two side regions and a convex surface or a concave surface along a front-back direction formed in each of a front region and a rear region on an upper waste receiving surface.

SUMMARY OF THE INVENTION

However, in the flush toilet disclosed in each of Japanese Patent Laid-Open Nos. 2015-68126, 2015-68125, and 2015-68127, when flush water swirling on the waste receiving surface flows down gradually, the flush water is still dispersed on the waste receiving surface. Vertical agitation of flush water in a pooled water portion by a pressing flow pressing waste into the pooled water portion is insufficient, and waste is not sufficiently discharged.

If the amount of flush water is reduced in accordance with a recent request for water saving, flush water swirling on the waste receiving surface decreases. This makes the problem of insufficient discharge of waste due to insufficient vertical agitation of flush water in the pooled water portion by a pressing flow pressing waste into the pooled water portion more pronounced.

Under the circumstances, the present invention has been made to solve the related-art problem, and has as its object to provide a flush toilet capable of generating a relatively strong pressing flow pressing waste into a pooled water portion and improving waste discharging performance.

In order to attain the above-described object, according to the present invention, there is provided a flush toilet which cleans the toilet with flush water supplied from a flush water source and discharges waste, including a bowl that includes a bowl-shaped waste receiving surface, a rim formed above the waste receiving surface, and a pooled water portion formed below the waste receiving surface, a discharge passage that has an inlet connected to the pooled water portion and discharges waste, and a spout portion that spouts flush water onto the bowl and forms a swirling flow on the waste receiving surface, wherein the waste receiving surface of the bowl has a sectorial recess that is formed between a front end portion of the waste receiving surface and a front end portion of the pooled water portion so as to spread from the pooled water portion toward the front end portion of the waste receiving surface.

In the present invention with the above-described configuration, flush water swirling on the waste receiving surface can be made easy to guide from a relatively wide region toward the pooled water portion by the sectorial recess formed so as to spread from the pooled water portion toward the front end portion of the waste receiving surface, and flush water guided by the sectorial recess is collected toward the front end portion of the pooled water portion. As a result, the present invention allows generation of a relatively strong pressing flow pressing waste into the pooled water portion and improvement in waste discharging performance.

According to the present invention, the recess in the waste receiving surface of the bowl is preferably formed such that radii of curvature of a central bottom surface of the recess in respective cross-sections along a lateral direction decrease from the front end portion of the waste receiving surface toward the front end portion of the pooled water portion.

In the present invention with the above-described configuration, the recess is formed such that a radius of curvature of the central bottom surface decreases from the front end portion of the waste receiving surface toward the front end portion of the pooled water portion. In a region of the recess on a side closer to the front end portion of the waste receiving surface, the radius of curvature of the central bottom surface of the recess is relatively large, and a swirling flow of flush water can be made relatively easy to maintain. In a region of the recess on a side closer to the front end portion of the pooled water portion, the radius of curvature of the central bottom surface of the recess is relatively small, and a swirling flow of flush water can be made easier to guide toward the pooled water portion. It is thus possible to maintain a swirling flow in the region of the recess on the side closer to the front end portion of the waste receiving surface and to collect flush water as flows in a direction toward the pooled water portion during a revolution of each swirling flow, the ordinal number of which is relatively small, and form a bulk flow in the direction toward the pooled water portion in the region on the side closer to the front end portion of the pooled water portion. Additionally, flows of flush water directed in the direction toward the pooled water portion in the recess are collected along the central bottom surface having a smallest radius of curvature toward the front end portion of the pooled water portion in a region in the vicinity of the front end portion of the pooled water portion. Thus, a stronger pressing flow pressing waste into the pooled water portion can be generated, and the waste discharging performance can be further improved.

According to the present invention, the recess in the waste receiving surface of the bowl is preferably formed as a sector having a central angle in a range of 30° to 120°.

In the present invention with the above-described configuration, the recess is formed as the sector having the central angle in the range of 30° to 120°. Flush water swirling on the waste receiving surface can be made easy to guide from the relatively wide region toward the pooled water portion by the sectorial recess formed to have the central angle in the range of 30° to 120°. Additionally, flush water guided by the recess is collected toward the front end portion of the pooled water portion. This allows generation of a stronger pressing flow pressing waste into the pooled water portion and improvement in the waste discharging performance.

According to the present invention, the recess in the waste receiving surface of the bowl is preferably formed such that a radius of curvature of the central bottom surface in a cross-section along the lateral direction in a vicinity of the front end portion of the pooled water portion is in a range of 10 mm to 120 mm.

In the present invention with the above-described configuration, of flush water swirling on the waste receiving surface, flush water as a swirling flow in the vicinity of the front end portion of the pooled water portion can be made easy to guide toward the pooled water portion by the recess formed such that the radius of curvature of the central bottom surface is in the range of 10 mm to 120 mm.

Additionally, flows of flush water directed in the direction toward the pooled water portion in the recess are more reliably collected along the central bottom surface having a radius of curvature in the range of 10 mm to 20 mm toward the front end portion of the pooled water portion in the region in the vicinity of the front end portion of the pooled water portion. Thus, a stronger pressing flow pressing waste into the pooled water portion can be generated, and the waste discharging performance can be improved.

According to the present invention, the recess in the waste receiving surface of the bowl is preferably formed such that a vertical distance from the central bottom surface of the recess to a shelf increases from the front end portion of the waste receiving surface toward the front end portion of the pooled water portion.

In the present invention with the above-described configuration, the recess is formed such that the vertical distance from the central bottom surface to the shelf increases from the front end portion of the waste receiving surface toward the front end portion of the pooled water portion. In the region of the sectorial recess on the side closer to the front end portion of the waste receiving surface, the vertical distance from the central bottom surface of the recess to the shelf is relatively small, and a swirling flow of flush water can be made relatively easy to maintain. In the region of the sectorial recess on the side closer to the front end portion of the pooled water portion, the vertical distance from the central bottom surface of the recess to the shelf is relatively long, and a swirling flow of flush water can be made easier to guide toward the pooled water portion. It is thus possible to maintain a swirling flow in the region of the recess on the side closer to the front end portion of the waste receiving surface and to collect flush water as flows in the direction toward the pooled water portion during a revolution of each swirling flow, the ordinal number of which is relatively small, and form a bulk flow in the direction toward the pooled water portion in the region on the side closer to the front end portion of the pooled water portion. Thus, a stronger pressing flow pressing waste into the pooled water portion can be generated, and the waste discharging performance can be further improved.

The flush toilet according to the present invention collects flush water swirling on the waste receiving surface toward the front end portion of the pooled water portion by the sectorial recess formed so as to spread from the pooled water portion. This allows generation of a relatively strong pressing flow pressing waste into the pooled water portion and improvement in the waste discharging performance.

DETAILED DESCRIPTION OF THE PREFERRED EMBODIMENT

A flush toilet according to an embodiment of the present invention will be described below with reference to the accompanying drawings. In the following description of the embodiment of the present invention, a right side as viewed from the front of a toilet main body 2 is described as a right side, and a left side as viewed from the front is described as a left side. A center line C is a center line dividing the toilet main body 2 into two left and right halves.

The flush toilet according to the embodiment of the present invention is a wash down flush toilet which pushes away waste by the action of running water caused by a difference in water level inside a bowl. Note that the present embodiment can also be applied to, e.g., a siphon flush toilet other than a wash down flush toilet.

Figure 1:
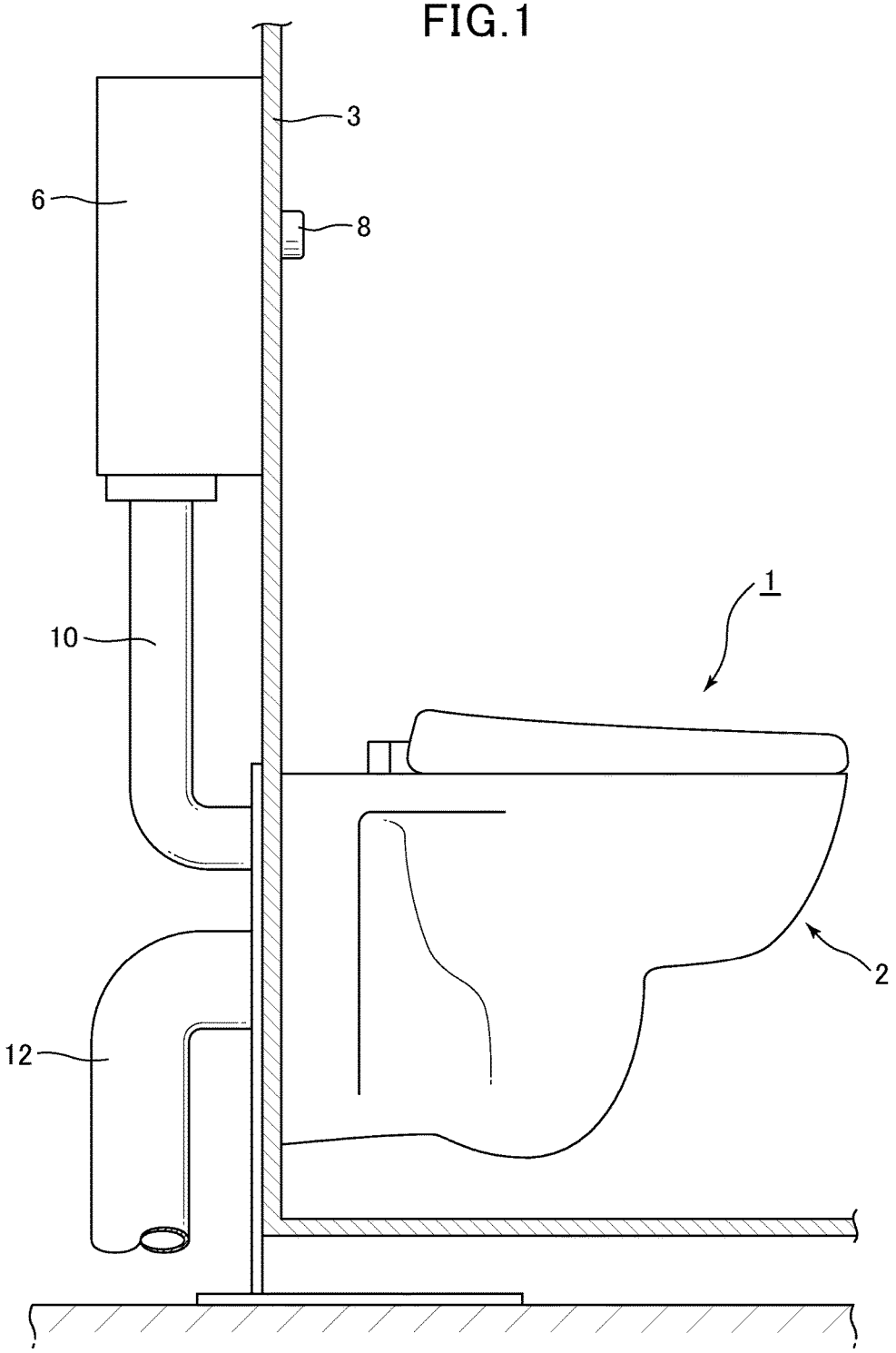
FIG. 1 is an overall schematic view showing a flush toilet according to an embodiment of the present invention.

As shown in FIG. 1, a flush toilet 1 according to the embodiment of the present invention includes the toilet main body 2 that is attached to an obverse face of a wall surface 3 and a storage tank 6 as a flush water source which is attached to an upper portion of a reverse face of the wall surface 3 and stores flush water. An operation switch 8 is attached to the obverse face of the wall surface 3. The storage tank 6 and the toilet main body 2 are connected by a connecting pipe 10. When the operation switch 8 is operated and turned on, flush water inside the storage tank 6 is supplied to the toilet main body 2 through the connecting pipe 10. In the present embodiment, the toilet main body 2 is made of ceramic. Note that the toilet main body 2 may be made of resin.

A discharge pipe 12 for discharging waste is attached to the reverse face of the wall surface 3. The discharge pipe 12 is connected to the toilet main body 2 to discharge waste inside the toilet main body 2.

The amount of flush water supplied from the storage tank 6 in the flush toilet 1 ranges from 3 liters to 6.5 liters, more preferably from 3.8 liters to 6.5 liters, and still more preferably from 4.8 liters to 6 liters. Note that a flush valve or the like may be used as a water supply device instead of the storage tank 6 in the present embodiment.

The structure of the toilet main body of the flush toilet according to the embodiment of the present invention will be described with reference to FIGS. 2 and 3.

Figure 2:
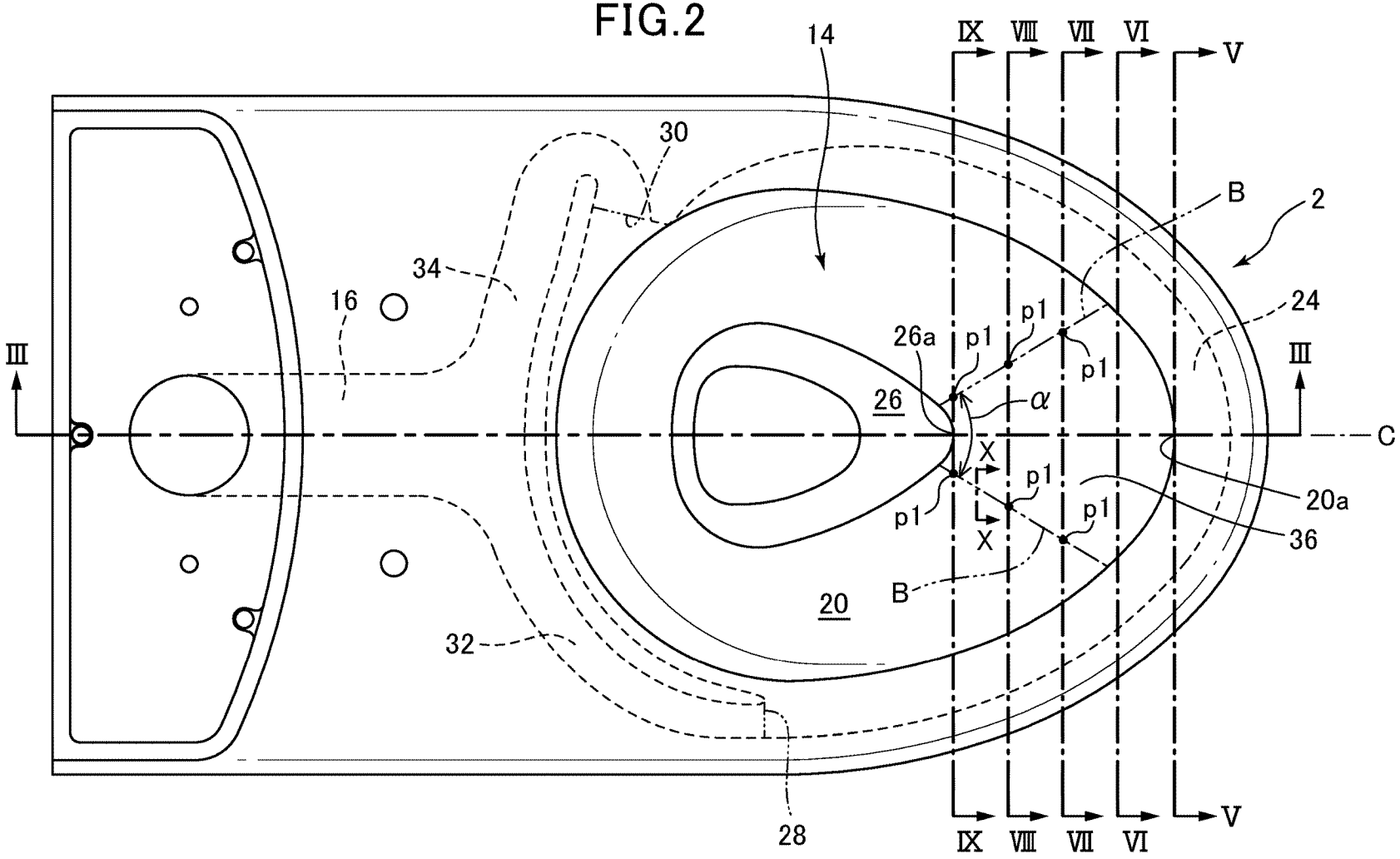
FIG. 2 is a plan view showing a toilet main body of the flush toilet according to the embodiment of the present invention.
Figure 3:
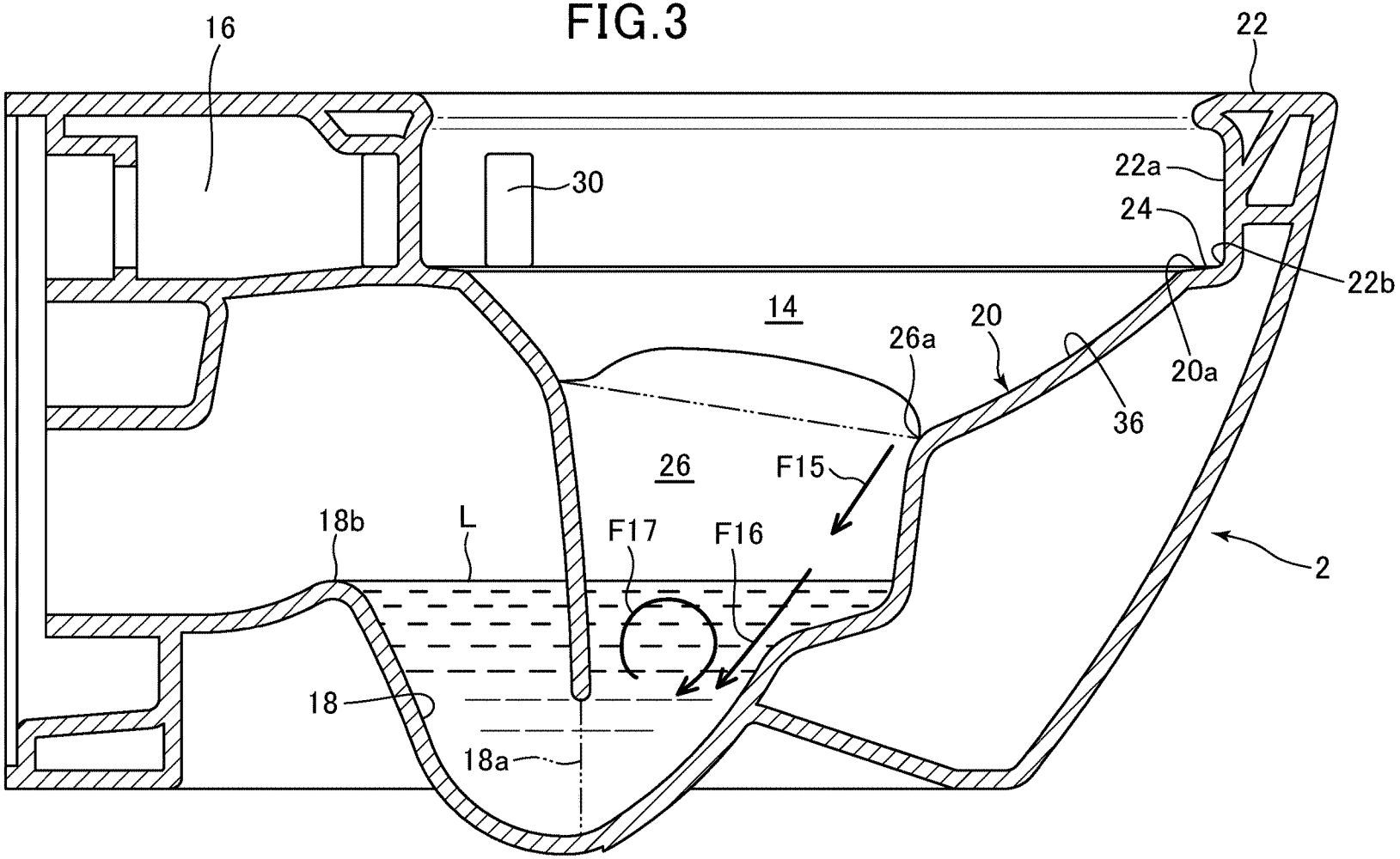
FIG. 3 is a cross-sectional view of the flush toilet as viewed along line III-III in FIG. 2.

As shown in FIGS. 2 and 3, in the toilet main body 2 of the flush toilet 1, a bowl 14 is formed at a front portion, and a common water conduit 16 is formed at a rear upper portion. The common water conduit 16 supplies flush water from the storage tank 6 to the bowl 14. A discharge trap conduit 18 (a discharge passage) for discharging waste is formed at a rear lower portion of the toilet main body 2.

The bowl 14 includes a bowl-shaped waste receiving surface 20, a rim 22 which is formed above the waste receiving surface 20, and a pooled water portion 26 which is formed below the waste receiving surface 20 and forms a depression for storage of pooled water.

The waste receiving surface 20 includes a shelf 24 forming a flat surface at an upper end portion. The shelf 24 is almost horizontally formed to swirl flush water and extends almost all the way around the upper end portion of the waste receiving surface 20. An inner circumference surface 22*a* which extends in a perpendicular direction from an outer end of the shelf 24 is formed at the rim 22.

The height of the shelf 24 is almost uniform across the whole circumference. Note that the shelf 24 may be formed such that the height decreases toward a front side or the shelf 24 may be formed in another way to have a different inclined portion. In each of cross-sections along a lateral direction orthogonal to the center line C as will be described later, a height of the shelf 24 on the right side and a height of the shelf 24 on the left side are set to be almost the same.

A first spout 28 (a spout portion) is formed slightly behind a central portion on the left side as viewed from the front of the inner circumference surface 22*a* of the rim 22 in the bowl 14, and a second spout 30 (a spout portion) is formed on a rear side of the bowl 14 on the right side as viewed from the front. The first spout 28 spouts flush water on the shelf 24 toward a front portion of the bowl 14. The second spout 30 spouts flush water toward a rear portion of the bowl 14. With the first spout 28 and the second spout 30, swirling flows in identical counterclockwise directions are formed on the waste receiving surface 20.

The flush toilet 1 is a flush toilet of a type including no jet spout which directly sprays and supplies flush water at the pooled water portion 26 of the bowl 14 or an inlet 18*a* of the discharge trap conduit 18 (to be described later).

The common water conduit 16 branches into a first water conduit 32 and a second water conduit 34 toward the toilet front. Flush water is supplied to the first spout 28 through the first water conduit 32 while flush water is supplied to the second spout 30 through the second water conduit 34.

Note that the first water conduit 32 including the first spout 28 and the second water conduit 34 including the second spout 30 are formed integrally with the ceramic toilet main body 2 in the flush toilet 1. Note that the first water conduit and the second water conduit may be formed from a distributor or the like separate from the toilet main body.

In the flush toilet 1, the second water conduit 34 and the second spout 30 may be omitted, and flush water may be supplied to the first spout 28 only by the first water conduit 32.

The pooled water portion 26 of the bowl 14 has an almost triangular shape in top view and has a tapered shape on a front side of the bowl 14 and an arc-like shape on a rear side. A front end portion 26*a* of the pooled water portion 26 is formed on the center line C and is connected to a recess 36 of the waste receiving surface 20 (to be described later).

The discharge trap conduit 18 extends obliquely upward from the inlet 18*a* that is open at a bottom portion of the pooled water portion 26 and passes through an apex 18*b*. After that, the discharge trap conduit 18 extends rearward and is connected to the discharge pipe 12.

A pooled water level L of the pooled water portion 26 of the flush toilet 1 is determined by the height of the apex 18*b* of the discharge trap conduit 18.

The waste receiving surface 20 of the bowl 14 will be described in detail with reference to FIGS. 4 to 11.

Figure 4:
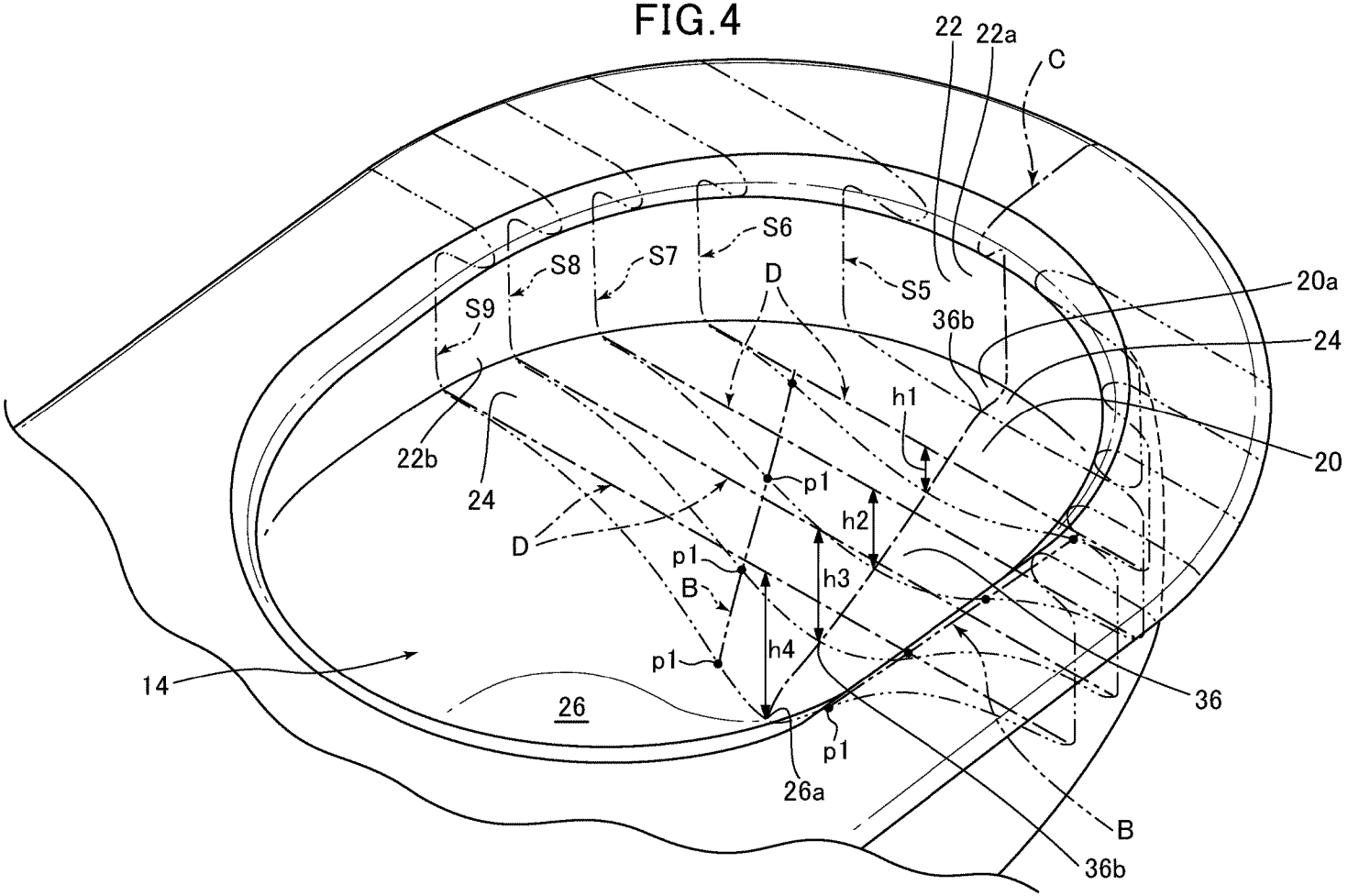
FIG. 4 is a schematic perspective view of a recess in a bowl of the flush toilet according to the embodiment of the present invention as viewed from a left-side rear portion of the toilet main body.

In FIG. 4, regarding surface shapes of the recess 36, a virtual line S5 indicates the position of a cross-section of the bowl 14 taken along line V-V in FIG. 2 (i.e., a surface shape of the bowl 14); a virtual line S6, the position of a cross-section of the bowl 14 taken along line VI-VI in FIG. 2; a virtual line S7, the position of a cross-section of the bowl 14 taken along line VII-VII in FIG. 2; a virtual line S8, the position of a cross-section of the bowl 14 taken along line VIII-VIII in FIG. 2; and a virtual line S9, the position of a cross-section of the bowl 14 taken along line IX-IX in FIG. 2.

Figure 5:
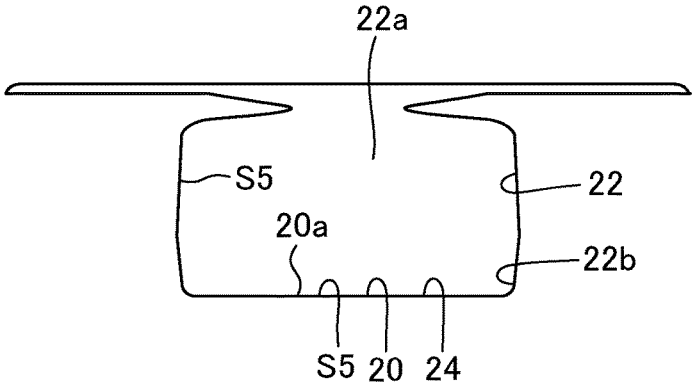
FIG. 5 is a cross-sectional view of the bowl of the flush toilet as viewed along line V-V in FIG. 2.
Figure 6:
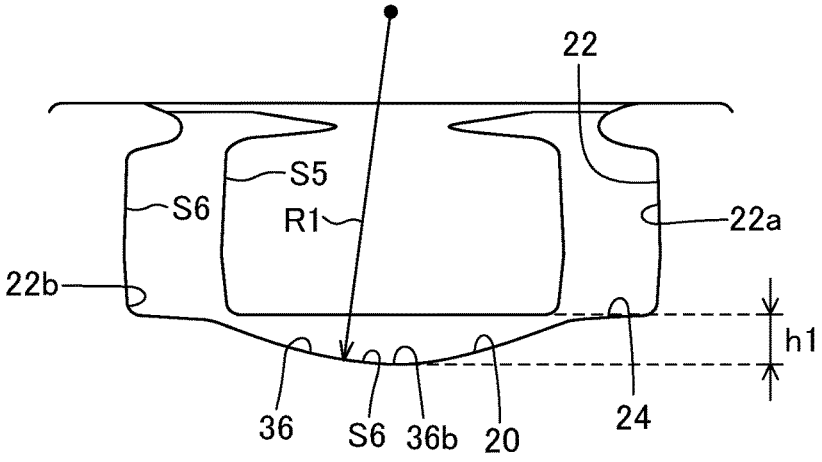
FIG. 6 is a cross-sectional view of the bowl of the flush toilet as viewed along line VI-VI in FIG. 2.
Figure 7:
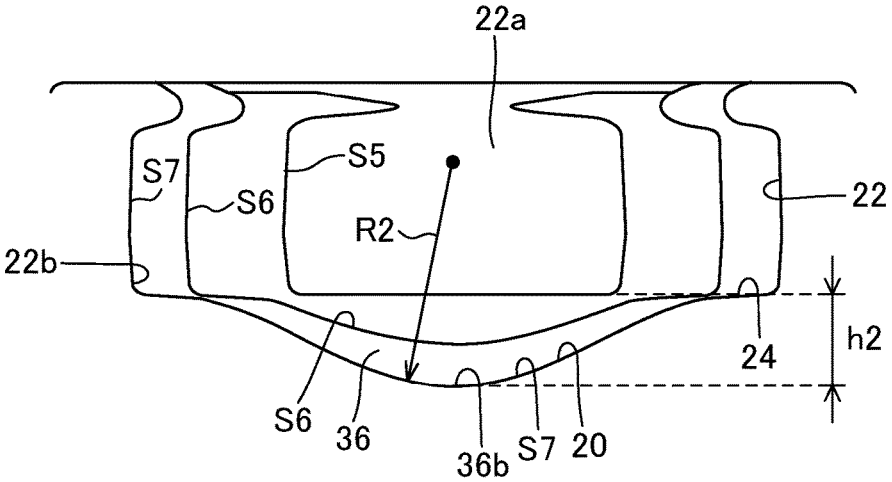
FIG. 7 is a cross-sectional view of the bowl of the flush toilet as viewed along line VII-VII in FIG. 2.
Figure 8:
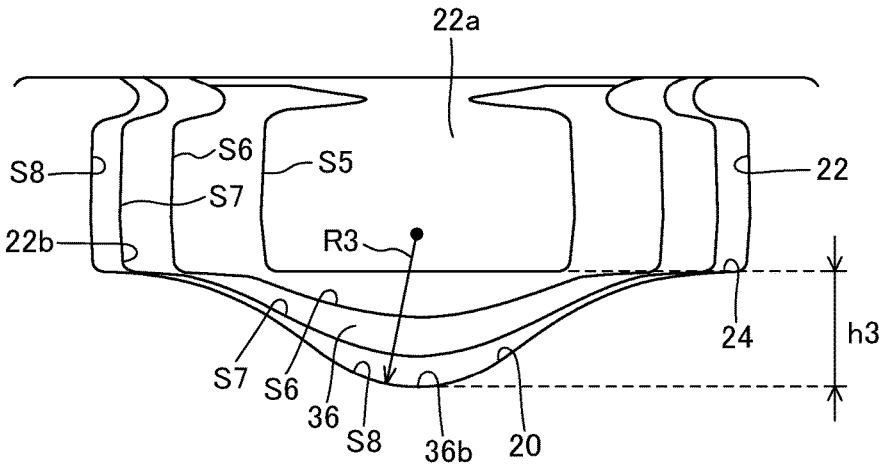
FIG. 8 is a cross-sectional view of the bowl of the flush toilet as viewed along line VIII-VIII in FIG. 2.
Figure 9:
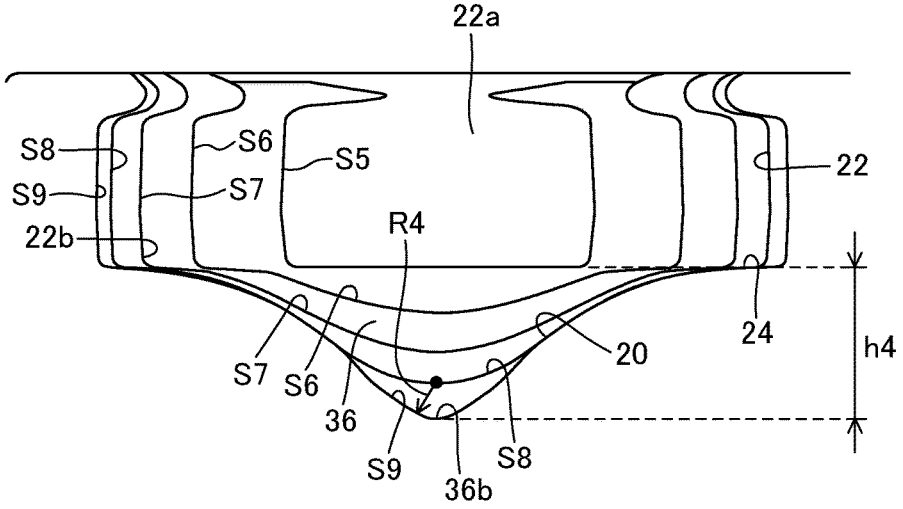
FIG. 9 is a cross-sectional view of the bowl of the flush toilet as viewed along line IX-IX in FIG. 2.

A cross-section V-V shown in FIG. 5, a cross-section VI-VI shown in FIG. 6, a cross-section VII-VII shown in FIG. 7, a cross-section VIII-VIII shown in FIG. 8, and a cross-section IX-IX shown in FIG. 9 are respective cross-sections at positions obtained by quadrisecting a distance from the position of the front end portion 20*a* of the waste receiving surface 20 to the position of the front end portion 26*a* of the pooled water portion 26 on the center line C.

The waste receiving surface 20 of the bowl 14 forms the sectorial recess 36 that spreads out forward from the pooled water portion 26 between the front end portion 20*a* of the waste receiving surface 20 and the front end portion 26*a* of the pooled water portion 26. The recess 36 is formed so as to extend forward radially from the front end portion 26*a* of the pooled water portion 26 as a center. The recess 36 forms a depressed surface of the waste receiving surface 20, and flush water flowing into the recess 36 is likely to stay in the recess 36. Flush water staying in the recess 36 is guided toward the pooled water portion 26, as will be described later.

Figures 10, 11:
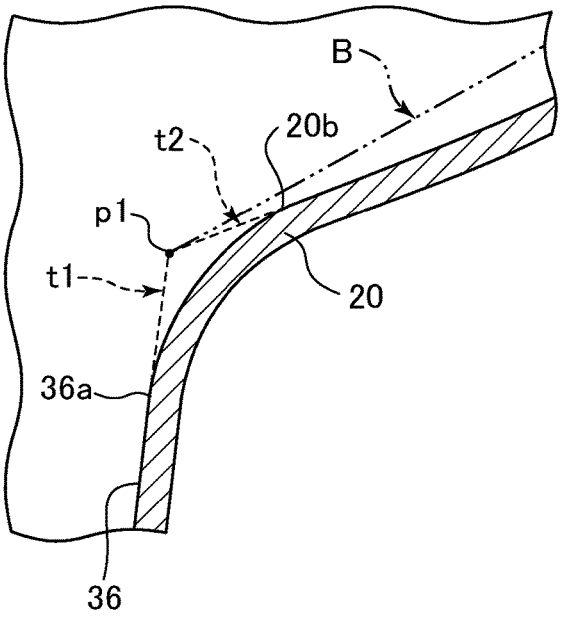
FIG. 10 is a cross-sectional view of the bowl of the flush toilet as viewed along line X-X in FIG. 2.
FIG. 11 is a chart showing a vertical distance from a central bottom surface of a recess to a shelf and a radius R of curvature of the recess in each cross-section of the recess in a waste receiving surface of the flush toilet according to the embodiment of the present invention.

As shown in FIG. 10, an intersection at which a tangent t1 to an upper end portion 36*a* of the recess 36 and a tangent t2 to a connecting portion 20*b* of the waste receiving surface 20 which is connected to the upper end portion 36*a* of the recess 36 intersect is obtained in each cross-section along the lateral direction orthogonal to the center line C. The intersection lies at substantially the same position as a point p1 of inflection between the recess 36 and the waste receiving surface 20 connected to the recess 36. Virtual lines B connecting the points p1 of inflection, a pair of points p1 of inflection being defined for each cross-section, in a front-back direction indicate two ends of the recess 36 that is a sectorial region (see FIGS. 2 and 4). The recess 36 is formed to be bilaterally symmetrical with respect to the center line C, and a central bottom surface 36*b* which is a deepest portion of the recess 36 is formed at a position on the center line C. In the recess 36, the central bottom surface 36*b* has an arc-like shape having almost a single radius of curvature in each cross-section along the lateral direction.

As shown in FIG. 2, a central angle $\alpha$ between the two virtual lines B that define the two ends of the sectorial region of the recess 36 is defined to be in the range of 30° to 120°. Thus, the recess 36 is formed as a sector having a central angle in the range of 30° to 120°, more preferably 30° to 90°. For example, the recess 36 is formed as a sector having a central angle of 62°.

As shown in FIG. 4, the recess 36 in the waste receiving surface 20 is formed such that distances from the central bottom surface 36*b* to the shelf 24 in the respective cross-sections along the lateral direction orthogonal to the center line C increase from the front end portion 20*a* of the waste receiving surface 20 toward the front end portion 26*a* of the pooled water portion 26. FIG. 4 shows a line connecting left and right portions of the shelf 24 of the toilet main body 2 as a reference line D. Note that although the heights of four reference lines D shown in FIG. 4 are almost the same in the present embodiment, the heights of the reference lines D may be slightly different from one another.

The central bottom surface 36*b* of the recess 36 is formed so as to descend gradually along the center line C from the front end portion 20*a* of the waste receiving surface 20 toward the front end portion 26*a* of the pooled water portion 26.

In the recess 36, a vertical distance from the central bottom surface 36*b* to the shelf 24 increases gradually along the center line C from the front end portion 20*a* of the waste receiving surface 20 toward the front end portion 26*a* of the pooled water portion 26. More specifically, as shown in FIGS. 4 and 5, the central bottom surface 36*b* of the recess 36 coincides with the shelf 24 in the cross-section V-V. As shown in FIGS. 4 and 6, a vertical distance h1 from the central bottom surface 36*b* of the recess 36 to the shelf 24 is set to about 20 mm in the cross-section VI-VI. As shown in FIGS. 4 and 7, a vertical distance h2 from the central bottom surface 36*b* of the recess 36 to the shelf 24 is set to about 38 mm in the cross-section VII-VII. As shown in FIGS. 4 and 8, a vertical distance h3 from the central bottom surface 36*b* of the recess 36 to the shelf 24 is set to about 52 mm in the cross-section VIII-VIII. As shown in FIGS. 4 and 9, a vertical distance h4 from the central bottom surface 36*b* of the recess 36 to the shelf 24 is set to about 68 mm in the cross-section IX-IX.

As shown in FIG. 9, a position of the central bottom surface 36*b* of the recess 36 on the virtual line S5 at a position along line V-V, a position of the central bottom surface 36*b* of the recess 36 on the virtual line S6 at a position along line VI-VI, a position of the central bottom surface 36*b* of the recess 36 on the virtual line S7 at a position along line VII-VII, and a position of the central bottom surface 36*b* of the recess 36 on the virtual line S8 at a position along line VIII-VIII are set at positions in descending order of height. A position of the central bottom surface 36*b* of the recess 36 on the virtual line S9 at a position along line IX-IX is set at a position lowest among the positions.

The recess 36 in the waste receiving surface 20 is formed such that radii of curvature of the central bottom surface 36*b* of the recess 36 in the cross-sections along the lateral direction decrease from the front end portion 20*a* of the waste receiving surface 20 toward the front end portion 26*a* of the pooled water portion 26. The recess 36 forms a V-shaped depression in each cross-section along the lateral direction.

In the cross-section V-V as shown in FIGS. 4 and 5, the central bottom surface 36*b* of the recess 36 is formed as an almost flat surface which coincides with the shelf 24.

As shown in FIGS. 6 and 11, a radius R1 of curvature of the central bottom surface 36*b* of the recess 36 is about 115 mm long in the cross-section VI-VI.

As shown in FIGS. 7 and 11, a radius R2 of curvature of the central bottom surface 36*b* of the recess 36 is about 85 mm long in the cross-section VII-VII.

As shown in FIGS. 8 and 11, a radius R3 of curvature of the central bottom surface 36*b* of the recess 36 is about 64 mm long in the cross-section VIII-VIII.

As shown in FIGS. 9 and 11, a radius R4 of curvature of the central bottom surface 36*b* of the recess 36 is about 15 mm long in the cross-section IX-IX. As described above, the radius of curvature of the central bottom surface 36*b* of the recess 36 decreases gradually from the front end portion 20*a* of the waste receiving surface 20 toward the front end portion 26*a* of the pooled water portion 26. As shown in FIGS. 6 to 9, the width of a passage in the lateral direction at a position at a predetermined vertical distance from a lowermost portion 36*c* of the central bottom surface 36*b* decreases gradually from the front end portion 20*a* of the waste receiving surface 20 toward the front end portion 26*a* of the pooled water portion 26. As shown in FIG. 9, the recess 36 is formed such that a radius of curvature of the central bottom surface 36*b* of the recess 36 in a cross-section (the cross-section IX-IX) along the lateral direction in the vicinity of the front end portion 26*a* of the pooled water portion 26 falls within the range of 10 mm to 20 mm.

Figure 12:
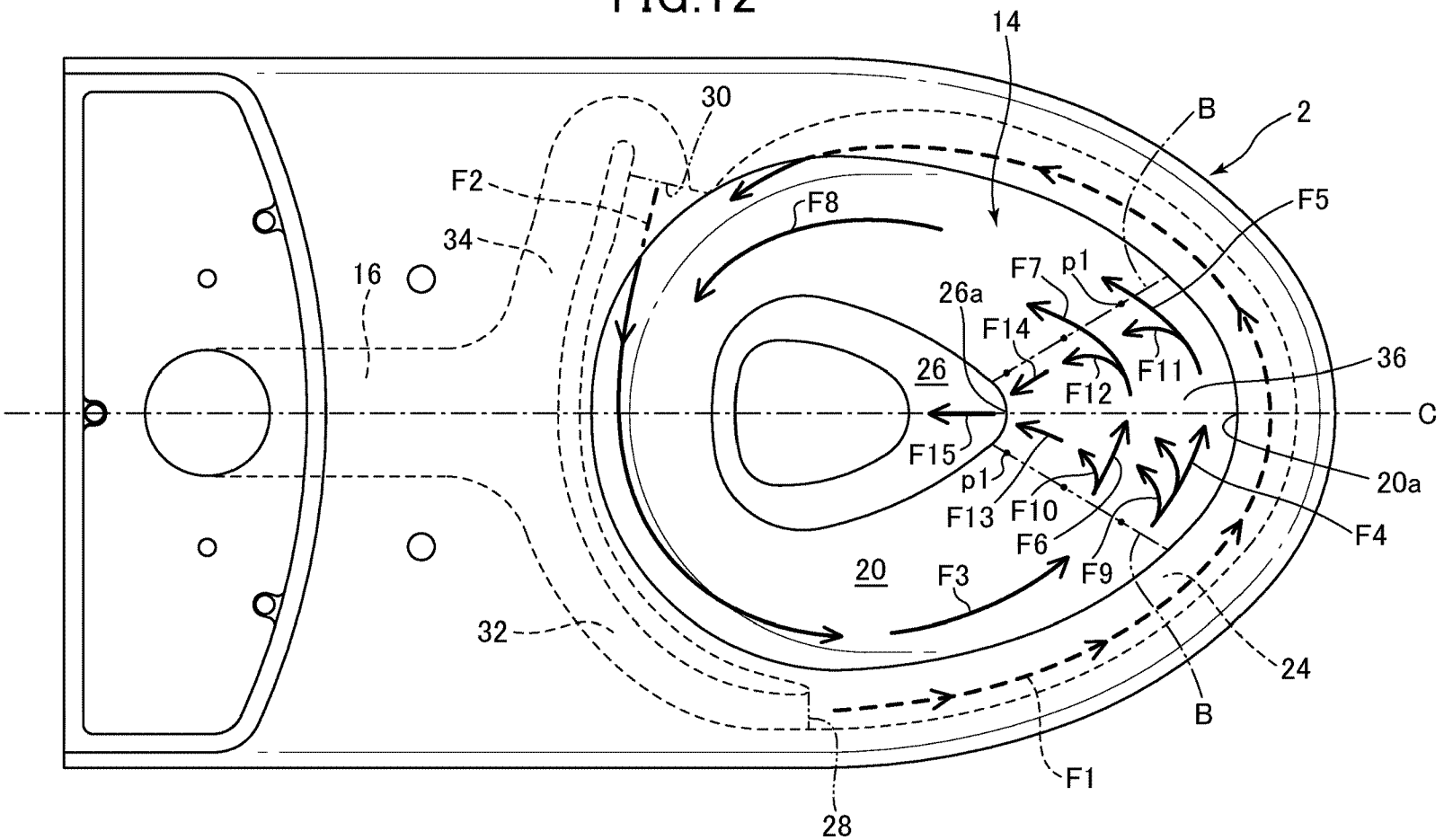
FIG. 12 is a plan view showing a flow of flush water in the flush toilet according to the embodiment of the present invention.

The operation of the flush toilet according to the embodiment of the present invention will be described with reference to FIG. 12.

When a user operates and turns on the operation switch 8 (see FIG. 1), flush water inside the storage tank 6 flows into the common water conduit 16 via the connecting pipe 10, reaches the first water conduit 32 and the second water conduit 34 that are branches of the common water conduit 16, and is spouted through the first spout 28 and the second spout 30.

Flush water spouted through the first spout 28 is spouted onto the shelf 24 formed at the waste receiving surface 20 to mainly form a swirling flow which swirls on the shelf 24, as indicated by an arrow F1.

Flush water spouted through the second spout 30 is spouted onto the shelf 24 formed at the waste receiving surface 20 to mainly form a swirling flow which swirls on the shelf 24, as indicated by an arrow F2.

In this case, flush water flowing down gradually from the shelf 24 at the waste receiving surface 20 forms swirling flows below the shelf 24 at the waste receiving surface 20, as indicated by arrows F3, F4, F5, F6, F7, and F8.

Since the sectorial recess 36 is formed in the waste receiving surface 20, flows from the vicinities of the two ends of the recess 36 in a direction toward a center (a direction toward the center line C) of the recess 36 and in a direction toward the front end portion 26*a* of the pooled water portion 26 are likely to be formed, as indicated by arrows F9, F10, F11, and F12. Additionally, the points p1 of inflection (and the virtual lines B connecting the points p1 of inflection) are present at two left and right end portions of the recess 36. The flow rate of flush water passing on the point p1 of inflection decreases, and flow components toward the pooled water portion 26 increase. This forms a flow in a direction toward the pooled water portion 26 in the recess 36.

Since the recess 36 is a sector having the central angle $\alpha$ in the range of 30° to 120°, flush water swirling on the waste receiving surface 20 is collected from a relatively wide region having a central angle in the range of 30° to 120° and extending radially to form flows toward the pooled water portion 26, as indicated by the arrows F9, F10, F11, and F12.

The recess 36 in the waste receiving surface 20 is formed such that the radii of curvature of the central bottom surface 36*b* of the recess 36 in the cross-sections along the lateral direction decrease from the front end portion 20*a* of the waste receiving surface 20 toward the front end portion 26*a* of the pooled water portion 26. In a region of the recess 36 on a side closer to the front end portion 20*a* of the waste receiving surface 20, the radius R1 of curvature of the central bottom surface 36*b* is relatively large, and flush water flowing into the recess 36 is likely to rise smoothly and flow out again after flowing down along a curved surface having the radius R1 of curvature to the central bottom surface 36*b*. This allows formation of a flow of flush water in a state where a swirling flow is relatively maintained. In a region of the sectorial recess 36 on a side closer to the front end portion 26*a* of the pooled water portion 26, for example, the radius R4 of curvature (or the radius R2 or R3 of curvature) of the central bottom surface 36*b* is relatively small, and flush water flowing into the recess 36 abruptly change direction along a curved surface having the radius R4 of curvature after flowing down to the central bottom surface 36*b* and is unlikely to rise and flow out again. For this reason, the flush water is made to stay in the recess 36, the direction of the flow is changed to the direction toward the pooled water portion 26, and a swirling flow of the flush water is made easier to guide toward the pooled water portion 26. It is thus possible to maintain a swirling flow in the region of the recess 36 on the side closer to the front end portion 20*a* of the waste receiving surface 20 and to collect flush water as flows in the direction toward the pooled water portion 26 in the region on the side closer to the front end portion 26*a* of the pooled water portion 26. A bulk flow in the direction toward the pooled water portion 26 is formed.

Flows of flush water directed in the direction toward the pooled water portion 26 in the recess 36 are concentrated on the vicinity of the center line C along the central bottom surface 36*b* having the smallest radius R4 of curvature (e.g., a radius of curvature in the range of 10 mm to 20 mm) in a region in the vicinity of the front end portion 26*a* and move down toward the front end portion 26*a* in a concentrated manner.

In the recess 36 in the waste receiving surface 20, the vertical distance from the central bottom surface 36*b* to the shelf 24 increases from the waste receiving surface front end portion 20*a* toward the front end portion 26*a* of the pooled water portion 26. In the region of the sectorial recess 36 on the side closer to the front end portion 20*a* of the waste receiving surface 20, the vertical distance from the central bottom surface 36*b* of the recess 36 toward the shelf 24 is relatively small, and flush water flowing into the recess 36 is likely to rise and flow out again after flowing down to the central bottom surface 36*b*. This allows formation of a flow of flush water in a state where a swirling flow is relatively maintained. In the region of the sectorial recess 36 on the side closer to the front end portion 26*a* of the pooled water portion 26, the vertical distance from the central bottom surface 36*b* of the recess 36 to the shelf 24 is relatively large, and flush water flowing into the recess 36 is unlikely to rise and flow out again after flowing down to the central bottom surface 36*b*. The flush water is made to stay in the recess 36, the direction of the flow is changed to the direction toward the pooled water portion 26, and a swirling flow of the flush water is made easier to guide toward the pooled water portion 26.

It is thus possible to maintain a swirling flow in the region of the recess 36 on the side closer to the waste receiving surface front end portion 20*a* and to collect flush water as flows in the direction toward the pooled water portion 26 during a revolution of each swirling flow, the ordinal number of which is relatively small, in a region closer to the front end portion 26*a* of the pooled water portion 26 than the waste receiving surface front end portion 20*a*. A bulk flow in the direction toward the pooled water portion 26 is formed.

Additionally, the recess 36 is formed such that the central bottom surface 36*b* descends toward the front end portion 26*a* of the pooled water portion 26 (a downward slope is formed). A flow sending flows collected on the central bottom surface 36*b* toward and into the front end portion 26*a* of the pooled water portion 26 in an accelerated manner is formed.

The percentage of flows directed in the direction toward the pooled water portion 26 in the recess 36 to swirling flows of flush water passing through the recess 36 in the waste receiving surface 20 can be increased, and flush water can be collected from the recess 36 and be made to flow to the pooled water portion 26.

More specifically, after a flow swirling on the waste receiving surface 20 is changed in direction to the direction toward the pooled water portion 26 and a direction toward the central bottom surface 36*b* in the recess 36, flush water is collected on and along the central bottom surface 36*b* of the recess 36, as indicated by arrows F13 and F14. A concentrated flow from a lower end of the central bottom surface 36*b* to the front end portion 26*a* of the pooled water portion 26 is formed, as indicated by an arrow F15 (see FIGS. 12 and 13). The radius of curvature of the central bottom surface 36*b* of the recess 36 decreases gradually from the waste receiving surface front end portion 20*a* toward the front end portion 26*a* of the pooled water portion 26, and flush water is collected on the central bottom surface 36*b* along a curved surface having the decreasing radius of curvature. Basically, flows of flush water directed in the direction toward the pooled water portion 26 in the recess 36 are collected into one main flow. The force and the flow rate of the main flow into the front end portion 26*a* of the pooled water portion 26 are more than in a case where flows are dispersed in the surroundings.

In FIG. 3, a concentrated flow from the recess 36 into the front end portion 26*a* of the pooled water portion 26 forms a longitudinal pressing flow, as indicated by an arrow F16 to produce a strong force pressing waste on the pooled water portion 26 in a downward direction (the longitudinal direction). For this reason, a force vertically agitating flush water and waste (e.g., floating waste) in the pooled water portion 26 is produced to form, for example, a vertical agitating flow, as indicated by an arrow F17. As a result, even in the case of the flush toilet with no spout (jet port) provided at a side portion of the waste receiving surface 20 of the toilet main body 2, waste can be efficiently pressed into the discharge trap conduit 18 and be efficiently discharged.

Even in a case where the amount of flush water is reduced in accordance with a recent request for water saving, flush water flowing through the recess 36 in the waste receiving surface 20 is collected during a second revolution (e.g., a second revolution after flush water spouted through the first spout 28 or the like swirls mainly on the shelf 24 during a first revolution) that is relatively small in ordinal number, and the flush water collected from the recess 36 is made to flow to the pooled water portion 26. This inhibits flush water from continuing swirling on the waste receiving surface 20 to be dispersed and a force pressing the flush water into the pooled water portion 26 from being weakened. It is possible to maintain cleaning power on the waste receiving surface 20 and secure a force pressing flush water into the pooled water portion 26.

In the above-described flush toilet 1 according to the present embodiment, flush water swirling on the waste receiving surface 20 can be made easy to guide from the relatively wide region on the waste receiving surface 20 toward the pooled water portion 26 by the sectorial recess 36 formed so as to spread from the pooled water portion 26, and flush water guided by the recess 36 is collected toward the front end portion 26*a* of the pooled water portion 26. This allows generation of a relatively strong pressing flow pressing waste into the pooled water portion 26 and improvement in waste discharging performance.

Note that the flush toilet 1 according to the present embodiment is formed such that the radius of curvature of the central bottom surface 36*b* of the recess 36 decreases from the front end portion 20*a* of the waste receiving surface 20 toward the front end portion 26*a* of the pooled water portion 26. In the region of the recess 36 on the side closer to the front end portion 20*a* of the waste receiving surface 20, the radius of curvature of the central bottom surface 36*b* of the recess 36 is relatively large, and a swirling flow of flush water can be made relatively easy to maintain. In the region of the recess 36 on the side closer to the front end portion 26*a* of the pooled water portion 26, the radius of curvature of the central bottom surface 36*b* of the recess 36 is relatively small, and a swirling flow of flush water can be made easier to guide toward the pooled water portion 26. It is thus possible to maintain a swirling flow in the region of the recess 36 on the side closer to the front end portion 20*a* of the waste receiving surface 20 and to collect flush water as flows in the direction toward the pooled water portion 26 during a revolution of each swirling flow, the ordinal number of which is relatively small, and form a bulk flow in the direction toward the pooled water portion 26 in the region on the side closer to the front end portion 26*a* of the pooled water portion 26.

Additionally, flows of flush water directed in the direction toward the pooled water portion 26 in the recess 36 are collected along the central bottom surface 36*b* having a smallest radius of curvature toward the front end portion 26*a* of the pooled water portion 26 in the region in the vicinity of the front end portion 26*a* of the pooled water portion 26. Thus, a stronger pressing flow pressing waste into the pooled water portion 26 can be generated, and the waste discharging performance can be further improved.

In the flush toilet 1 according to the present embodiment, the recess 36 is formed as a sector having the central angle $\alpha$ in the range of 30° to 120°. For this reason, flush water swirling on the waste receiving surface 20 can be made easy to guide from the relatively wide region toward the pooled water portion 26 by the sectorial recess 36 formed to have the central angle $\alpha$ in the range of 30° to 120°, and flush water guided by the recess 36 is collected toward the front end portion 26*a* of the pooled water portion 26. This allows generation of a stronger pressing flow pressing waste into the pooled water portion 26 and improvement in the waste discharging performance.

In the flush toilet 1 according to the present embodiment, of flush water swirling on the waste receiving surface 20, flush water as a swirling flow in the vicinity of the front end portion 26*a* of the pooled water portion 26 can be made easy to guide toward the pooled water portion 26 by the recess 36 formed such that the radius of curvature of the central bottom surface 36*b* is in the range of 10 mm to 120 mm (10R to 120R). Additionally, flows of flush water directed in the direction toward the pooled water portion 26 in the recess 36 are more reliably collected along the central bottom surface 36*b* having a radius of curvature in the range of 10 mm to 20 mm (10R to 20R) toward the front end portion 26*a* of the pooled water portion 26 in the region in the vicinity of the front end portion 26*a* of the pooled water portion 26. Thus, a stronger pressing flow pressing waste into the pooled water portion 26 can be generated, and the waste discharging performance can be improved.

In the flush toilet 1 according to the present embodiment, the recess 36 is formed such that the vertical distance from the central bottom surface 36*b* to the shelf 24 increases from the front end portion 20*a* of the waste receiving surface 20 toward the front end portion 26*a* of the pooled water portion 26. For this reason, in the region of the sectorial recess 36 on the side closer to the front end portion 20*a* of the waste receiving surface 20, the vertical distance from the central bottom surface 36*b* of the recess 36 to the shelf 24 is relatively small, and a swirling flow of flush water can be made relatively easy to maintain. In the region of the sectorial recess 36 on the side closer to the front end portion 26*a* of the pooled water portion 26, the vertical distance from the central bottom surface 36*b* of the recess 36 to the shelf 24 is relatively large, and a swirling flow of flush water can be made easier to guide toward the pooled water portion 26. It is thus possible to maintain a swirling flow in the region of the recess 36 on the side closer to the front end portion 20*a* of the waste receiving surface 20 and to collect flush water as flows in the direction toward the pooled water portion 26 during a revolution of each swirling flow, the ordinal number of which is relatively small, and form a bulk flow in the direction toward the pooled water portion 26 in the region on the side closer to the front end portion 26*a* of the pooled water portion 26. Thus, a stronger pressing flow pressing waste into the pooled water portion 26 can be generated, and the waste discharging performance can be further improved.

What is claimed is:

1. A flush toilet which cleans the toilet with flush water supplied from a flush water source and discharges waste, comprising:

a bowl that includes a bowl-shaped waste receiving surface, a rim formed above the waste receiving surface, and a pooled water portion formed below the waste receiving surface;

a discharge passage that has an inlet connected to the pooled water portion and discharges waste;

a spout portion that spouts flush water onto the bowl and forms a swirling flow on the waste receiving surface, wherein the waste receiving surface of the bowl has a sectional recess that is formed between a front end portion of the waste receiving surface and a front end portion of the pooled water portion so as to spread laterally from the pooled water portion toward the front end portion of the waste receiving surface, said sectional recess having both lateral ends extending in a front-back direction which are lines defined by inflection points between the recess and the waste receiving surface connected to the recess in each cross-section along a lateral direction orthogonal to a center line along a front-back direction of the bowl.

2. The flush toilet according to claim 1, wherein the recess in the waste receiving surface of the bowl is formed such that radii of curvature of a central bottom surface of the recess in respective cross-sections along a lateral direction decrease from the front end portion of the waste receiving surface toward the front end portion of the pooled water portion.

3. The flush toilet according to claim 1, wherein the recess in the waste receiving surface of the bowl is formed as a sector having a central angle in a range of 30° to 120°.

4. The flush toilet according to claim 1, wherein the recess in the waste receiving surface of the bowl is formed such that a radius of curvature of the central bottom surface of the recess in a cross-section along the lateral direction at the front end portion of the pooled water portion is in a range of 10 mm to 120 mm.

5. The flush toilet according to claim 1, wherein the recess in the waste receiving surface of the bowl is formed such that a vertical distance from the central bottom surface of the recess to a shelf increases from the front end portion of the waste receiving surface toward the front end portion of the pooled water portion.

* * * * *